US005113542A

United States Patent [19]

Pastryk et al.

[11] Patent Number: 5,113,542

[45] Date of Patent: May 19, 1992

[54] CENTRIFUGAL SOFTENER SPRAY DISPENSER

[75] Inventors: Jim J. Pastryk, Weesaw Township, Berrien County; Sheryl L. Farrington, St. Joseph Township, Berrien County, both of Mich.

[73] Assignee: Whirlpool Corporation, Benton Harbor, Mich.

[21] Appl. No.: 635,481

[22] Filed: Dec. 28, 1990

Related U.S. Application Data

[63] Continuation-in-part of Ser. No. 461,404, Jan. 5, 1990, Pat. No. 4,987,627.

[51] Int. Cl.[5] ..... D06F 39/02

[52] U.S. Cl. ..... 8/158; 68/17 A

[58] Field of Search ..... 8/158; 68/17 A, 23.5, 68/207

[56] References Cited

U.S. PATENT DOCUMENTS

| | | | |
|---|---|---|---|
| 1,826,030 | 10/1931 | Snyder | 68/17 A |
| 2,792,701 | 5/1957 | Bochan | 68/17 A |
| 2,949,025 | 8/1960 | Tingley, Jr. | 68/207 |
| 2,953,006 | 9/1960 | Brucken et al. | 68/17 A |
| 2,973,636 | 3/1961 | Devery et al. | 68/17 A |
| 2,982,120 | 5/1961 | Pelensky | 68/17 A X |
| 3,079,783 | 3/1963 | Stanger | 68/207 |
| 3,091,108 | 5/1963 | Martin et al. | 68/17 A |
| 3,145,552 | 8/1964 | McMillan et al. | 68/17 A |
| 3,248,914 | 5/1966 | Tingley, Jr. | 68/207 |
| 3,481,163 | 12/1969 | Bochan et al. | 68/17 A X |
| 3,596,480 | 8/1971 | Douglas | 68/17 A |
| 3,736,773 | 6/1973 | Waugh | 68/17 A |
| 4,062,205 | 12/1977 | Morey et al. | 68/17 A X |
| 4,691,538 | 9/1987 | Shikamori et al. | 68/17 A X |

*Primary Examiner*—Philip R. Coe

*Attorney, Agent, or Firm*—Hill, Van Santen, Steadman & Simpson

[57] ABSTRACT

In an automatic washing, a wash additive dispenser is disposed in a tub, and a drive mechanism is provided for selectively rotating the dispenser at a first angular speed and a second, greater angular speed. The wash additive fluid dispenser may be mounted on an agitator. The dispenser includes first passages for permitting liquid flow from the dispenser into the tub when the dispenser is rotated at least as fast the first angular speed, and second passages for permitting liquid flow from the dispenser into the tub when the dispenser is rotated as least as fast as the second angular speed. The dispensing cup can include a frutoconical portion having a sidewall diverging upwardly and terminating in a radially outwardly-extending toroidal portion disposed at the upper end of the frustoconical portion. A method of dispensing wash additive fluid is disclosed which includes the steps of retaining wash additive fluid in the dispenser during agitation, and centrifugally dispensing wash additive fluid into the tub from dispensing passages in the dispenser wall during at least one spin cycle. The method may include the substeps of centrifugally dispensing a first portion of wash additive fluid into the tub during a first spin cycle, and centrifugally dispensing a second portion of wash additive fluid into the tub during a second spin cycle.

20 Claims, 4 Drawing Sheets

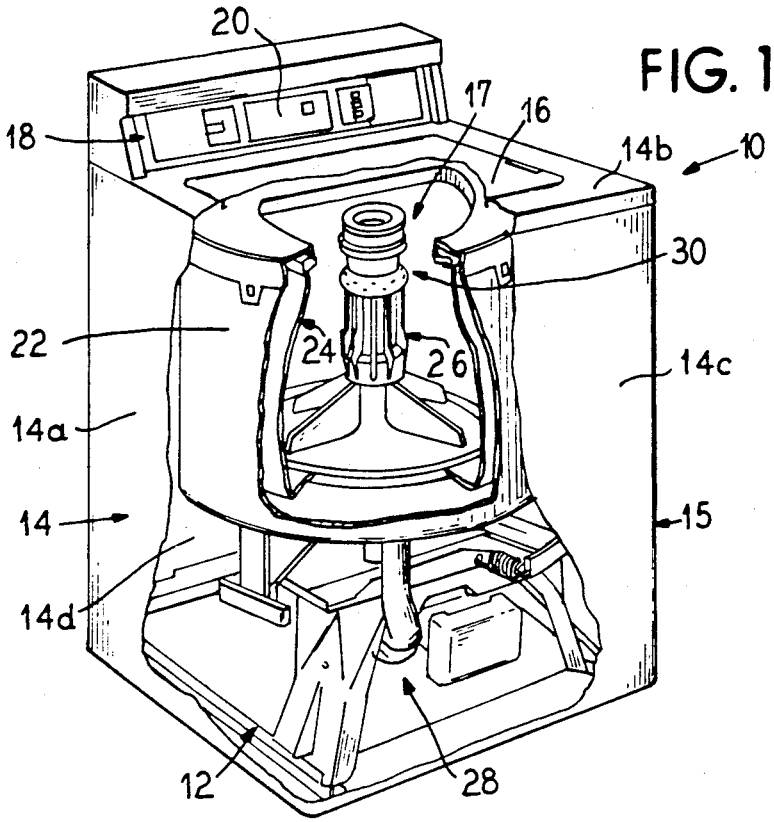
FIG. 1
FIG. 3
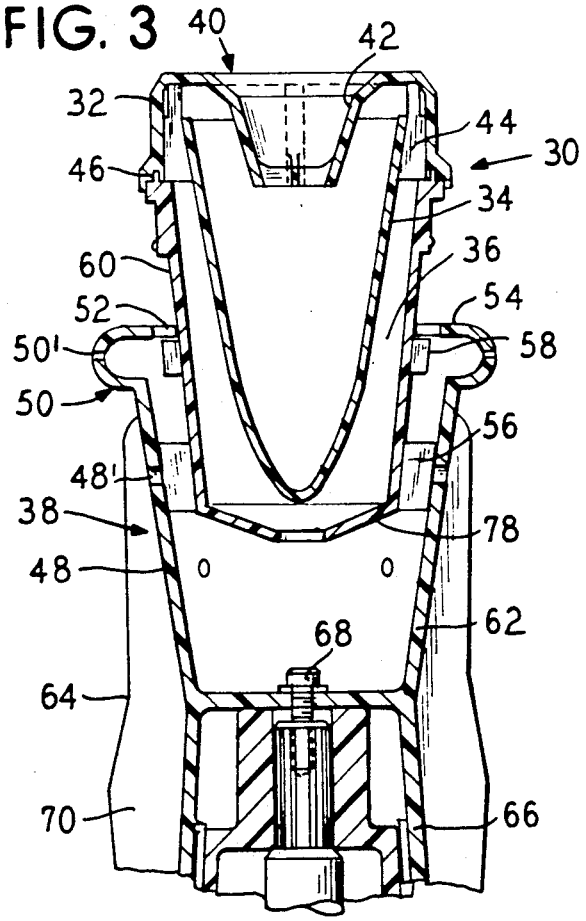
FIG. 4
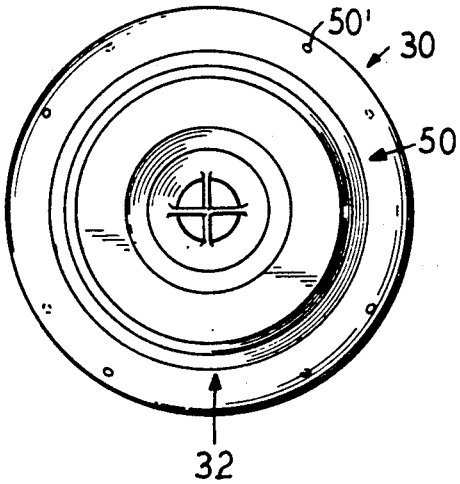

CENTRIFUGAL SOFTENER SPRAY DISPENSER

CROSS REFERENCE TO RELATED APPLICATION

This application is a continuation-in-part of U.S. application Ser. No. 07/461,404, filed Jan. 5, 1990, and now U.S. Pat. No. 4,987,627.

TECHNICAL FIELD

The invention is directed to additive dispensers in washing machines, and more specifically to centrifugally-actuated agitator-mounted wash additive dispenser for use in an automatic clothes washer.

BACKGROUND OF THE INVENTION

In a conventional agitator-mounted wash additive dispenser, the timing of fabric softener dispensing is determined by operation of the agitator. Dispensers are often provided with one or more chambers (or stages) so that fabric softener is transferred from an inner chamber to an outer chamber as a result of acceleration and deceleration of the agitator during a spin cycle. In such dispensers, fabric softener is dispensed by gravity flow into the tub during a deep fill portion of the rinse cycle.

However, so-called "high performance" washing machines have been developed in which there is no deep fill rinse. Such washers are exemplified by U.S. Pat. No. 4,784,666, assigned to the assignee of the present application, and incorporated herein by reference. This patent discloses a high performance washing process for vertical axis automatic washers which includes the recirculation of wash fluid through a spinning wash load prior to agitation. In place of a deep fill rinse, a wash basket is spun at high speed such that the wash load is centrifugally displaced against the basket. During spinning, the wash load is sprayed with recirculated spray rinses, flush spray rinses, or both. Since there is no deep fill rinse cycle, conventional rinse additive or fabric softener dispensers are unsuitable for use with high performance washing machines where flush spray rinses are utilized. Furthermore, conventional dispensers are designed to discharge their contents in one dispensing sequence. Due to the wash methods employed in the high performance washer, it may be desirable to affect two or more applications of fabric softener, in order to give a more uniform coverage of the clothes load.

SUMMARY OF THE INVENTION

The present invention provides a dispenser that is agitator-mounted, thus avoiding the necessity of reducing washer basket capacity by locating the dispenser elsewhere. The dispenser of the present invention does not require moving parts, and may be controlled entirely in response to forces produced by normal action of the washer, without the need for external controls. Thus, the dispenser of the present invention is inexpensive and easy to manufacture, while providing excellent predicted reliability.

The dispenser of the present invention does not prematurely empty its contents into the wash basket, and does not require a deep fill operation. The present invention allows the wash load to be sprayed evenly with wash additive. The present invention provides a dispenser for use in an automatic washer having an agitator disposed in the tub, and a drive mechanism for selectively rotating the agitator at a first angular speed, and a second, greater angular speed. The dispenser is mounted on the agitator, and includes first passages for permitting liquid flow from the dispenser into the tub when the agitator is rotated at least as fast as the first angular speed, and second passages for permitting liquid from the dispenser into the tub when the agitator is rotated at least as fast as the second angular speed. In an illustrative embodiment, the dispenser includes a frustoconical portion having a side wall diverging upwardly from a bottom wall to an upper end of the frustoconical portion, with the bottom wall being secured to the agitator. The dispenser also includes a radially outwardly-extending toroidal portion disposed at the upper end of the frustoconical portion. The first passages are formed in the frustoconical portion, and the second passages are formed in the toroidal portion.

The dispenser includes a receiving cup capable of receiving and containing a predetermined quantity of additive. The receiving cup is connected to the agitator for rotation therewith. A dispensing cup is secured to receive additive from the receiving cup, and is also connected to the agitator for rotation therewith. Rotation of the dispenser during a first spin cycle of the automatic washer initiates transfer of wash additive from the receiving cup into the dispensing cup, and rotation of the dispenser during a second spin cycle of the automatic washer causes the wash additive to be centrifugally dispensed into the tub from the dispensing cup.

At least one holding member is disposed between the receiving cup and the dispensing cup, wherein rotation of the dispenser during the first spin cycle causes the wash additive to be transferred from the receiving cup into the holding member. Slowing of the rotation of the dispenser during the first spin cycle initiates flow of the wash additive from the holding member into the dispensing cup.

The receiving cup, the holding member, and the dispensing cup each have a respective predetermined capacity for receiving fluid to be dispensed. In one embodiment, the respective capacities of the receiving cup, the holding member, and the dispensing cup are substantially equal to one another. This embodiment provides a single-stage dispensing of wash additive. In another embodiment, the respective capacities of the receiving cup and the holding member are substantially greater than the predetermined capacity of the dispensing cup. This second embodiment provides a multiple-stage dispensing of wash additive into the tub.

The holding member includes a downwardly-directed aperture for permitting gravity-induced flow of wash additive from the holding member into the dispensing cup.

A cover member may be provided including a surface for securing the cover member to the holding member, and a web arrangement for securing cover member to the receiving cup. A vane arrangement may be provided between the holding member and the dispensing cup for maintaining the holding member in a predetermined relative radial position with respect to the dispensing cup. Projections may be provided between the holding member and the dispensing cup for maintaining the holding member in a predetermined relative axial position with respect to the dispensing cup.

The agitator may include a plurality of agitator vanes disposed on the outer surface of the agitator, which extend axially along an outer surface of the dispensing cup.

The present invention also provides a method of dispensing wash additive fluid from a dispenser. The method includes the steps of retaining wash additive fluid in the dispenser during agitation, and centrifugally dispensing wash additive fluid into the tub from dispensing passages in the dispenser wall during at least one spin cycle.

The method may also include the sub-steps of centrifugally dispensing a first portion of wash additive fluid into the tub during a first spin cycle, and centrifugally dispensing a second portion of wash additive into the tub during a second spin cycle.

Other objects and advantages of the present invention will be apparent upon reference to the accompanying description when taken in conjunction with the following drawings.

BRIEF DESCRIPTION OF THE DRAWINGS

FIG. 1 illustrates a perspective view, partially cut away, of a washer embodying the present invention.

FIG. 3 illustrates a detailed sectional view of a dispenser embodying the present invention.

FIG. 4 is a top view of a dispenser embodying the present invention.

DESCRIPTION OF THE PREFERRED EMBODIMENT

Figure 2:
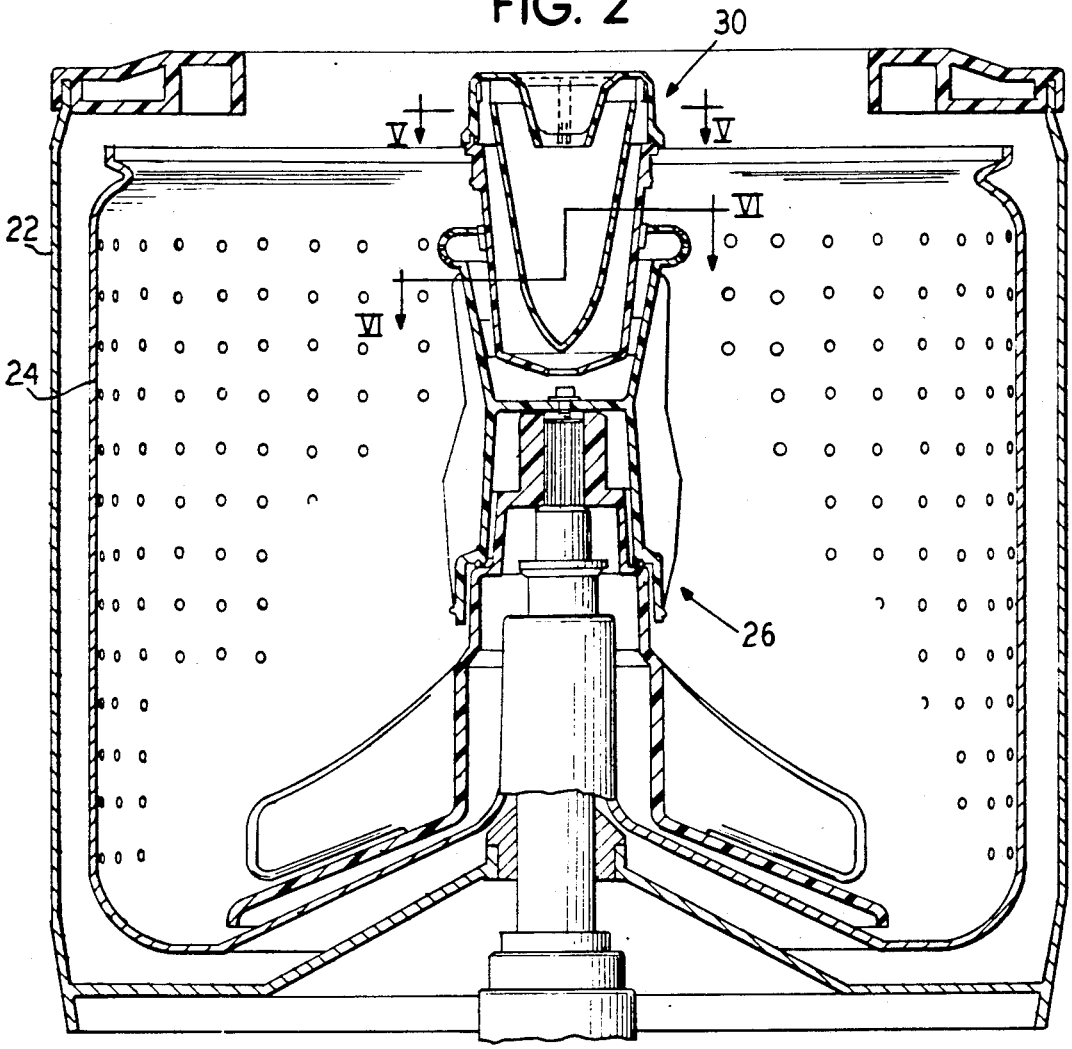
FIG. 2 illustrates a sectional view of a dispenser embodying the present invention in conjunction with a wash basket, wash tub, and agitator assembly.

In FIG. 1, the reference numeral 10 indicates generally a washing machine of the automatic type, i.e., a machine having a presettable sequential control mechanism for operating a washer through a pre-selected program of automatic washing, rinsing, and drying operations in which the present invention may be embodied. The machine 10 includes a frame 12 carrying vertical panels 14 forming the sides 14*a*, top 14*b*, front 14*c*, and back 14*d* of a cabinet 15 for the washing machine 10. A hinged lid 16 is provided in the usual manner to provide access to the interior or treatment zone 17 of the washing machine 10. The washing machine 10 has a console 18 including a control panel 20, upon which timer controls, temperature selectors, and other selectors, as desired, may be mounted.

The treatment zone 17 of the washing machine 10 is contained within an imperforate fluid containing tub 22 within which is mounted a perforate spin basket 24 and a vertically disposed agitator 26. Water supply and machine drive mechanisms are disposed in the area 28 generally below the tub 22.

FIGS. 2 and 3 illustrate in detail a wash additive dispenser 30 mounted atop the agitator 26 for rotation therewith. The dispenser 30 includes a cover member 32, a receiving cup 34, a holding member 36, and a dispensing cup 38.

The cover member 32 has a top opening 40 including a funnel member 42, through which liquid wash additive may be introduced to the dispenser 30. In the illustrated embodiment, the cover 32 is secured to the receiving cup 34 via a plurality of radial webs 44. A facing surface 46 of the cover member 32 is secured to the holding member 36 (for example, by spin-welding), thus securing both the cover 32 and the receiving cup 34 to the holding member 36.

Figure 6:
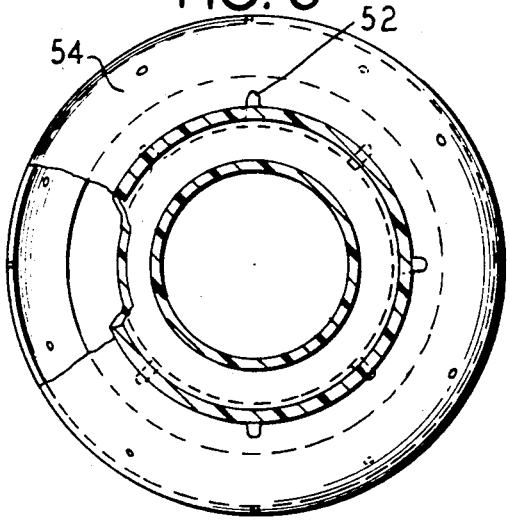
FIG. 6 is a sectional view taken along line VI—VI of FIG. 2.

In the illustrated embodiment, the cover 32, the receiving cup 34, and the holding member 36 are secured, as a unit, to the dispensing cup 38. The dispensing cup 38 includes a lower frustoconical portion 48 and an upper, preferably, but not necessarily, toroidal portion 50. As can be seen in FIG. 6, a plurality of slots 52 are provided in an upper wall 54 of the dispensing cup 38. The slots 52 are sized and positioned so as to permit axial passage of support vanes 56 and mounting projections 58 formed on the sidewall 60 of the holding member 36.

Figure 5:
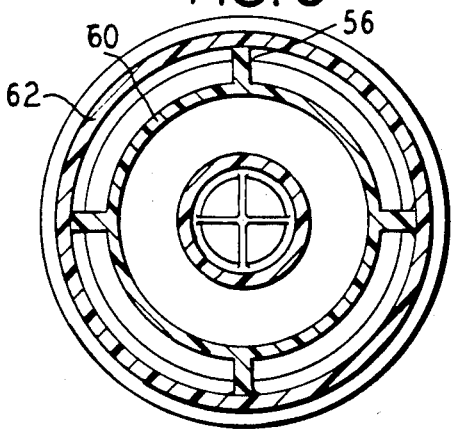
FIG. 5 is a sectional view taken along line V—V of FIG. 2.

As can be seen in FIG. 5, the support vanes 56 extend between a sidewall 62 of the dispensing cup 38 and the sidewall 60 of the holding member 36 to maintain the holding member in a predetermined relative radial position with respect to the dispensing cup. Although in the exemplary embodiment the support vanes 56 are shown as being secured to the holding member 36, it is also contemplated that similar support vanes could be formed with the frustoconical portion 48 of the dispensing cup 38. The frustoconical portion 48 of the dispensing cup 38 includes a plurality of radially disposed passages 48', and the toroidal portion 50 of the dispensing cup 38 includes a plurality of passages 50', the operation of which will be described in detail below.

The mounting projections 58 interact with the upper wall 54 of the dispensing cup 38 for maintaining the holding member 36 in a predetermined relative axial position with respect to the dispensing cup 38. Once the cover 32, the receiving cup 34, and the holding member 36 have been secured together as a unit as described above, the support vanes 56 and mounting projections 58 are aligned with the slots 52 in the upper wall 54 of the dispensing cup 38, and the holding member 36 is inserted into the dispensing cup 38 until the support vanes 56 come into contact with the sidewall 62. In this position, the mounting projections 58 are inside, but slightly below the upper wall 54. When the holding member 36 is then rotated to bring the mounting projections 58 out of alignment with the slots 52, an interference fit is created between the mounting projections 58 and the upper wall 54, thus securing the holding member 36 in a predetermined relative axial position with respect to the dispensing cup 38. Of course, it is to be understood that all of the above described securing arrangements are merely exemplary, and that any number of alternative arrangements will be apparent to one of ordinary skill in the art.

As can be seen in FIGS. 2 and 3, the dispenser 30 is secured to the agitator 26 of the washing machine 10. In the exemplary embodiment, a bottom wall 64 of the dispensing cup 38 is secured to the top of an agitator body 66 by means of a fastener 68. It is also contemplated that the dispenser 30 could be secured to the agitator 26 by other suitable methods, such as spin welding or gluing. In washing machines without agitators, it is contemplated that the dispenser could be mounted on a rotatable tower structure, or other suitable arrangement, within the wash tub.

The agitator includes a plurality of agitator vanes 70, which are disposed on the outer surface of the agitator body 66, and extend axially along the outer surface of the sidewall 62 of the dispensing cup 38.

Figure 7:
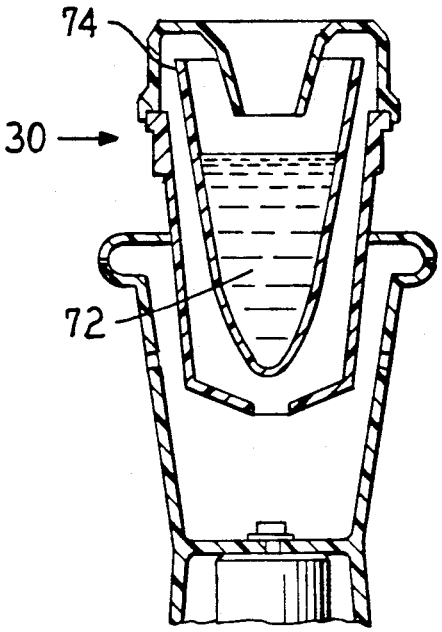
FIGS. 7 through 10 illustrate an operational embodiment of the present invention.

FIGS. 7 through 10 schematically illustrate the operation of a first embodiment of the present invention, in which wash additive fluid is retained in the dispenser during agitation, and centrifugally dispensed into the tub from the dispensing passages in the dispenser wall during one spin cycle. In FIG. 7, a predetermined quantity of wash additive fluid 72 has been introduced through the funnel member of the cover, and is held in the receiving cup. In this embodiment, each of the receiving cup, the holding member, and the dispensing cup has a predetermined capacity for receiving wash additive fluid, and the respective capacities are substantially equal to one another.

Figure 8:
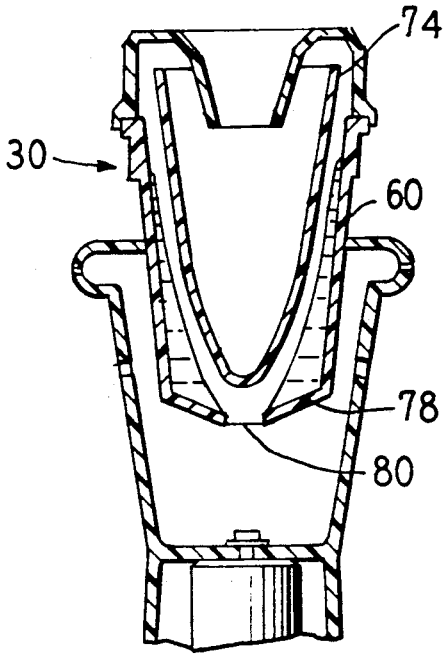
Figure 9:
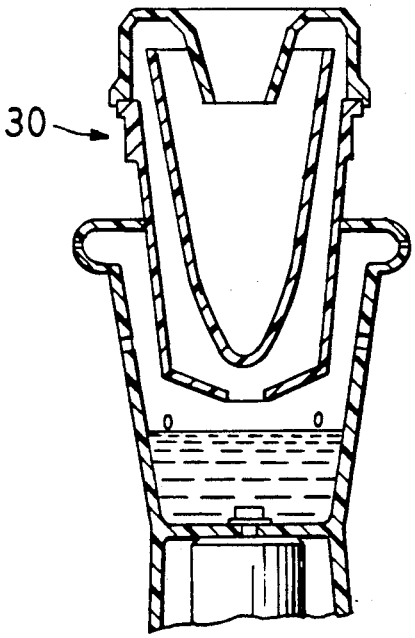

Centrifugal force generated by rotation of the agitator during a first spin cycle causes the contents of the receiving cup to be urged upwardly over an edge 74 of the receiving cup, and to be held along the interior of the sidewall 60 and bottom wall 78 of the holding member, as shown in FIG. 8. This centrifugal force abates as rotation of the agitator slows towards the end of the first spin cycle, so that the additive 72 is no longer held in the position shown in FIG. 8, but falls through an aperture 80 in the bottom wall 78 of the holding member, and is received in the bottom of the dispensing cup. Since the capacities of the receiving cup, the holding member, and the dispensing cup are substantially equal, all of the wash additive fluid 74 is held in the dispensing cup below the bottom wall 78 of the holding member, as shown in FIG. 9.

Figure 10:
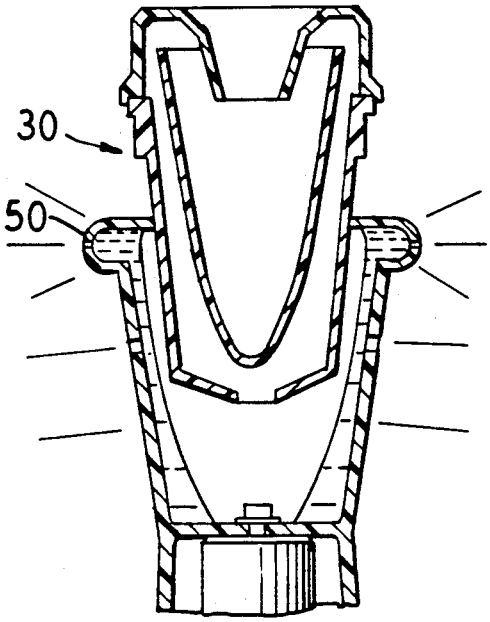

During a second spin cycle, centrifugal force generated by rotation of the agitator urges fluid within the dispensing cup 38 upwardly along the sidewall of the frustoconical portion, and up to the toroidal portion, of the dispensing cup 38. As the dispenser rotates with the agitator, wash additive fluid is urged outwardly through the passages 48' and 50'. In some machines, the rotational speed of the agitator during the spin cycle is increased incrementally. Thus, once the agitator reaches a first rotational speed, wash additive fluid first reaches, and is dispensed from, the passages 48' in the frustoconical portion of the dispensing cup. Subsequently, as the rotational speed of the agitator increases to a second level, wash additive fluid reaches, and is dispensed from, the passages 50' in the toroidal portion of the dispensing cup. As can be seen in FIG. 10, the toroidal portion of the dispensing cup provides a greater capacity for a "column" of wash additive fluid upstream of the dispensing passages 50', thus enhancing spraying action through the passages 50'.

Figure 11:
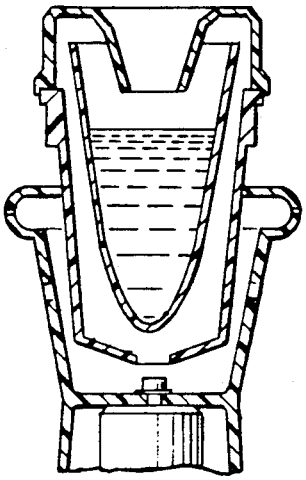
FIGS. 11 through 16 illustrate another operational embodiment of the present invention.
Figure 12:
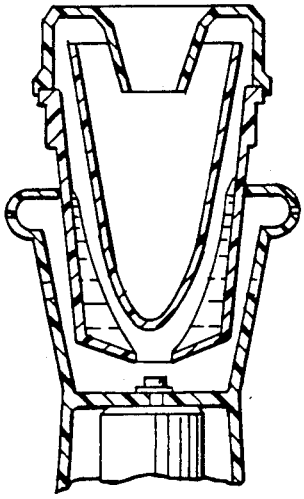
Figure 13:
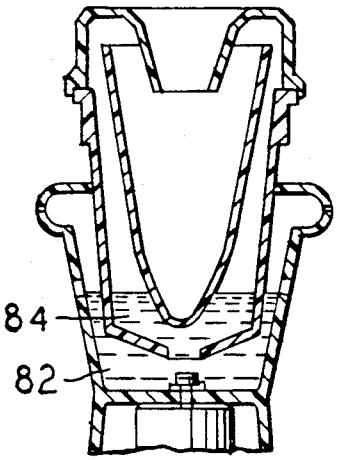
Figure 14:
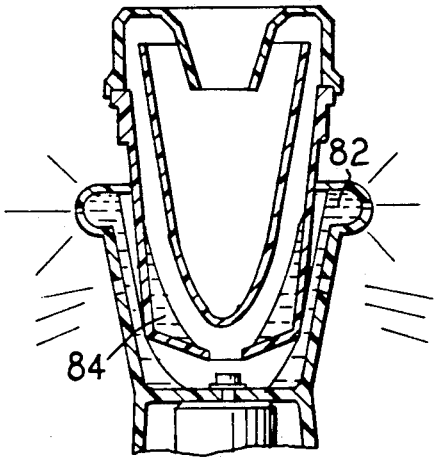
Figure 15:
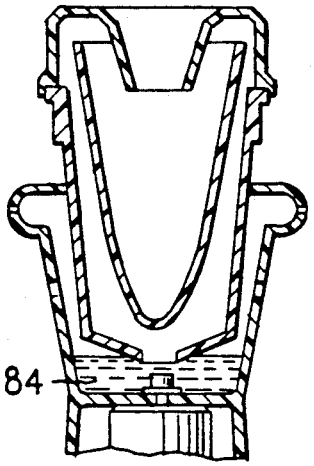
Figure 16:
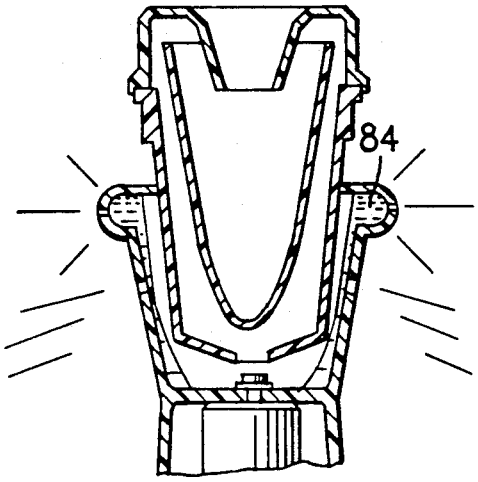

FIGS. 11 through 16 illustrate an embodiment of the present invention in which wash additive fluid is transferred from the receiving cup during a first spin cycle, a first portion of wash additive fluid is centrifugally dispensed into the tub from the dispensing passages during a second spin cycle, and a second portion of wash additive fluid is centrifugally dispensed from the dispensing passages during a third spin cycle. In this embodiment, the respective capacities of the receiving cup and the holding member are substantially greater than the predetermined capacity of the dispensing cup. FIGS. 11 and 12 are similar to FIGS. 7 and 8, in that they illustrate transfer of the wash additive fluid from the dispensing cup into the holding member during a first spin cycle. However, in this embodiment, after the first spin cycle, the level of wash additive fluid is above the bottom wall of the holding member, as shown in FIG. 13. Thus, during the second spin cycle, the wash additive fluid is separated into a first portion 82 and a second portion 84. The first portion 82 is dispensed into the tub during the second spin cycle, in a manner similar to that described with reference to FIG. 10, while the second portion of wash additive fluid is retained in the holding member. At the end of the second spin cycle, when rotational speed of the agitator slows down, the second portion 84 of wash additive fluid is transferred by gravity flow through the aperture in the bottom of the holding member, and is held in the dispensing cup at a level below the bottom wall of the holding member, as shown in FIG. 15. During a third spin cycle, as shown in FIG. 16, the second portion 84 of wash additive fluid is dispensed into the wash tub through the apertures in the dispensing cup in a manner described hereinabove with reference to FIG. 10.

Although the present invention has been described with reference to specific embodiments, those of skill in the art will recognize that the principles of the invention are subject to variation. For example, in a machine having more spin cycles than those of the illustrated embodiments, additional receiving cup/holding member combinations may be provided, so that wash additive would not be dispensed until the final spin cycle. Similarly, the capacity of the receiving cup and the holding member could be provided so as to even more greatly exceed the capacity of the receiving cup, so that the wash additive fluid would be dispensed in three or more portions. Accordingly, those of skill in the art will recognize that changes may be made to the specific embodiments of the present invention without departing from the scope and spirit of the invention as set forth in the appended claims.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. In an automatic washer including a wash tub, wash tub, a wash additive dispenser, and drive means for selectively rotating said dispenser at a first angular speed and a second, greater angular speed, a dispensing cup associated with said wash additive dispenser, said dispensing cup comprising:

first passage means, formed in said dispensing cup, for permitting liquid flow from said dispenser into said tub when said dispenser is rotated at least as fast as said first angular speed;

second passage means, formed in said dispensing cup, for permitting centrifugal liquid flow from said dispenser into said tub when said dispenser is rotated at least as said second angular speed; and said dispensing cup including a frustoconical portion having a sidewall diverging upwardly from a bottom wall to an upper end of said frustoconical portion, and a radially outwardly-extending toroidal portion disposed at said upper end of said frustoconical portion.

2. A dispensing cup according to claim 1, wherein said first passage means is formed in said frustoconical portion, and said second passage means is formed in said toroidal portion.

3. A dispensing cup according to claim 2, wherein said first means comprises a plurality of apertures formed in said frustoconical portion, and said second passage means comprises a plurality of apertures formed in said toroidal portion.

4. In an automatic washer having a tub, a basket disposed within said tub such as to rotate about a rotational axis and a motor for rotatably driving said basket about said rotational axis, a dispenser mounted within said basket for rotation therewith, said dispenser comprising:

a receiving cup capable of receiving and containing a predetermined quantity of additive, said receiving cup being connected to said agitator for rotation therewith;

a dispensing cup secured to receive additive from said receiving cup and being connected to said agitator for rotation therewith; and wherein said washer further includes means for rotating said dispenser during a first spin cycle of said automatic washer to initiate transfer of said predetermined quantity of additive from said receiving cup into said dispensing cup, and for rotating said dispenser during a second spin cycle of said automatic washer to cause said predetermined quantity of additive to be centrifugally dispensed into said dispensing cup.

5. A dispenser according to claim 4, further comprising at least one holding member disposed between said receiving cup and said dispensing cup, wherein said rotation of said dispenser during said first spin cycle of said automatic washer causes said predetermined quantity of additive to be transferred from said receiving cup into said holding member, and slowing of said rotation of said dispenser during said first spin cycle of said automatic washer initiates flow of said predetermined quantity of additive from said holding member into said dispensing cup.

6. A dispenser according to claim 5, wherein each of said receiving cup, said holding member, and said dispensing cup has a respective predetermined capacity for receiving fluid to be dispensed, and the respective capacities of said receiving cup and said holding member are substantially greater than the predetermined capacity of said dispensing cup.

7. A dispenser according to claim 5, wherein each of said receiving cup, said holding member, and said dispensing cup has a respective predetermined capacity for receiving fluid to be dispensed, and the respective capacities of said receiving cup, said holding member, and said dispensing cup are substantially equal to one another.

8. A dispenser according to claim 5, wherein said holding member comprises a downwardly-directed aperture means for permitting gravity-induced flow of said perdetermined quantity of additive from said holding member into said dispensing cup.

9. A dispenser according to claim 5, wherein said dispensing cup further comprises the following:

a bottom wall;

a frustoconical portion having a sidewall diverging upwardly from said bottom wall to an upper end of said frustoconical portion; and a radially outwardly-extending portion disposed at said upper end of said frustoconical portion.

10. A dispenser according to claim 9, wherein said dispensing cup further comprises the following:

a first plurality of apertures formed in said frustoconical portion of said dispensing cup; and a second plurality of apertures formed in said outwardly-extending portion of said dispensing cup.

11. A dispenser according to claim 9, wherein said outwardly-extending portion of said dispensing cup is toroidal.

12. A dispenser according to claim 5, further comprising a cover member having a generally annular sidewall, said cover member including the following:

surface means for securing said cover member to said holding member; and web means for securing said cover member to said receiving cup.

13. A dispenser according to claim 12, further comprising vane means, between said holding member and said dispensing cup, for maintaining said holding member in a predetermined relative position with respect to said dispensing cup.

14. A dispenser according to claim 13, further comprising projection means, between said holding member and said dispensing cup, for maintaining said holding member in a predetermined relative axial position with respect to said dispensing cup.

15. A dispenser according to claim 5, wherein said agitator comprises a plurality of agitator vanes, said agitator vanes being disposed on an outer surface of said agitator and exending axially along an outer surface of said dispensing cup.

16. In an automatic washer including a tub, and a dispenser mounted for selective rotation in an agitation cycle and at least one spin cycle, said dispenser having a sidewall with at least a portion of said sidewall extending upwardly from a bottom of said dispenser, and a plurality of dispensing passages extending through said portion of said sidewall, a method of dispensing wash additive fluid from said dispenser, said method comprising the following steps:

retaining a major portion of said wash additive fluid in said dispenser during said agitation cycle; and centrifugally dispensing said major portion of said wash additive fluid into said tub from said dispensing passages in said dispenser wall during said at least one spin cycle.

17. A method according to claim 16, wherein said at least one spin cycle includes a plurality of spin cycles, and said step of centrifugally dispensing said wash additive fluid into said tub comprises the following substeps:

centrifugally dispensing a first portion of said wash additive fluid into said tub from said dispensing passages in said dispenser wall during one of said plurality of spin cycles; and centrifugally dispensing a second portion of said wash additive fluid into said tub from said dispensing passages in said dispenser wall during a subsequent one of said spin cycles.

18. In an automatic washer having a tub and a dispenser mounted for rotation in said tub and including a holding member, and a dispensing cup, a method of dispensing wash additive fluid from said dispenser, said method comprising the following steps:

filling said receiving cup with a predetermined quantity of wash additive fluid;

transferring said predetermined quantity of fluid from said receiving cup to said holding member;

transferring a first portion of said predetermined quantity of wash additive fluid from said holding member into said dispensing cup, while retaining a second, remaining predetermined quantity of wash additive fluid in said holding member;

dispensing said first portion of said predetermined quantity of wash additive fluid into said tub from said dispenser cup;

transferring said second, remaining portion of said predetermined quantity of wash additive fluid from said holding member into said dispensing cup; and dispensing said second, remaining portion of said predetermined quantity of wash additive fluid into said tub from said dispenser cup.

19. In an automatic washer having a rotatable wash additive dispenser disposed in a tub and said dispenser including a receiving cup, a holding member, and a dispensing cup, a method of dispensing wash additive fluid from said dispenser into said tup, said method comprising the following steps:

providing said receiving cup with a fluid capacity greater than a fluid capacity of said dispensing cup;

providing said holding member with a fliud capacity greater than said fliud capacity of said dispensing cup;

filling said receiving cup to its fluid capacity with a wash additive fliud;

rotating said dispenser at a first predetermined speed sufficient to centrifugally transfer said wash additive fluid from said receiving cup to said holding member;

slowing roation of said dispenser below said first predetermined speed to permit a first portion of said wash additive fluid to flow from said holding member to said dispensing cup;

rotating said dispenser at a second predetermined speed sufficient to centrifugally dispense said first portion of wash additive fluid from said dispensing cup into said tub, while retaining a second, remaining portion of wash additive fluid in said holding member;

slowing rotation of said dispenser below said second predetermined speed to permit said second, remaining portion of said wash additive fluid to flow from said holding member to said dispensing cup; and rotating said dispenser at said second predetermined speed sufficient to centrifugally dispense said second, remaining portion of wash additive fluid from said dispensing cup into said tub.

20. A method according to claim 19, wherein said steps of rotation of said dispenser comprise stopping rotation of said dispenser.

* * * * *